US011492955B2

(12) United States Patent
Naganawa et al.

(10) Patent No.: US 11,492,955 B2
(45) Date of Patent: Nov. 8, 2022

(54) ENGINE

(71) Applicant: YANMAR POWER TECHNOLOGY CO., LTD., Osaka (JP)

(72) Inventors: Hiroaki Naganawa, Osaka (JP); Takayuki Onodera, Osaka (JP); Kazuma Sugimoto, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 0 days.

(21) Appl. No.: 16/762,545

(22) PCT Filed: Nov. 26, 2018

(86) PCT No.: PCT/JP2018/043388
§ 371 (c)(1),
(2) Date: May 8, 2020

(87) PCT Pub. No.: WO2019/116867
PCT Pub. Date: Jun. 20, 2019

(65) Prior Publication Data

US 2021/0293176 A1 Sep. 23, 2021

(30) Foreign Application Priority Data

Dec. 15, 2017 (JP) ..... JP2017-240460

(51) Int. Cl.
*F01P 7/16* (2006.01)
*F01M 5/00* (2006.01)
*F02F 1/10* (2006.01)

(52) U.S. Cl.
CPC ..... *F01P 7/16* (2013.01); *F01M 5/002* (2013.01); *F01M 5/007* (2013.01); *F02F 1/10* (2013.01); *F01P 2060/04* (2013.01)

(58) Field of Classification Search
CPC .. F01P 7/16; F01P 2060/04; F01P 3/02; F01P 3/12; F01P 11/08; F01P 3/20; F02F 1/10; F02F 7/007; F01M 5/007; F01M 5/002
See application file for complete search history.

(56) References Cited

U.S. PATENT DOCUMENTS

2003/0148679 A1* 8/2003 Matsuda ..... B63H 21/24 440/88 G
2015/0144312 A1* 5/2015 Ooi ..... F28D 9/0043 165/165

(Continued)

FOREIGN PATENT DOCUMENTS

EP 0637681 A1 2/1995
JP 56-159621 U1 4/1981

(Continued)

OTHER PUBLICATIONS

International Search Report for PCT Patent App No. PCT/JP2018/043388 (dated Jan. 29, 2019).

*Primary Examiner* — Joseph J Dallo
*Assistant Examiner* — Kurt Philip Liethen
(74) *Attorney, Agent, or Firm* — Cermak Nakajima & McGowan LLP; Tomoko Nakajima

(57) ABSTRACT

An engine includes: a cylinder block in which a cooling water passage is formed; an oil cooler accommodated in an accommodation part provided in the cooling water passage and having a plurality of cores for cooling an engine oil; a first oil pipe and a second oil pipe configured to support an oil inflow port and an oil ejection port of each of the cores; a cooling water inflow port provided in a lower portion of one end portion of the accommodation part relative to a front-and-rear direction; a cooling water outflow port provided in an upper portion of the accommodation part; and a (Continued)

cooling water inflow passage having an inclined portion inclined downward and connecting to the cooling water inflow port.

7 Claims, 8 Drawing Sheets

(56) References Cited

U.S. PATENT DOCUMENTS

| | | | | |
|---|---|---|---|---|
| 2016/0195000 | A1* | 7/2016 | Nakashima | F01P 3/02 123/41.74 |
| 2017/0205153 | A1* | 7/2017 | Hermida Domínguez | F28D 9/0037 |
| 2017/0314398 | A1* | 11/2017 | Slavens | F01D 5/186 |

FOREIGN PATENT DOCUMENTS

| | | | |
|---|---|---|---|
| JP | 57-180115 | U | 11/1982 |
| JP | 58-180313 | U | 12/1983 |
| JP | 63-042812 | U | 3/1988 |
| JP | 02-043406 | U | 3/1990 |
| JP | 05-087297 | U | 11/1993 |
| JP | 07-000655 | Y2 | 1/1995 |
| JP | 07-008529 | U | 2/1995 |
| JP | 07-022020 | U | 4/1995 |
| JP | 08-319830 | A | 12/1996 |
| JP | 2001-165589 | A | 6/2001 |
| JP | 2012-097948 | A | 5/2012 |
| JP | 2015-110934 | A | 6/2015 |

* cited by examiner

FIG. 4A TOP VIEW
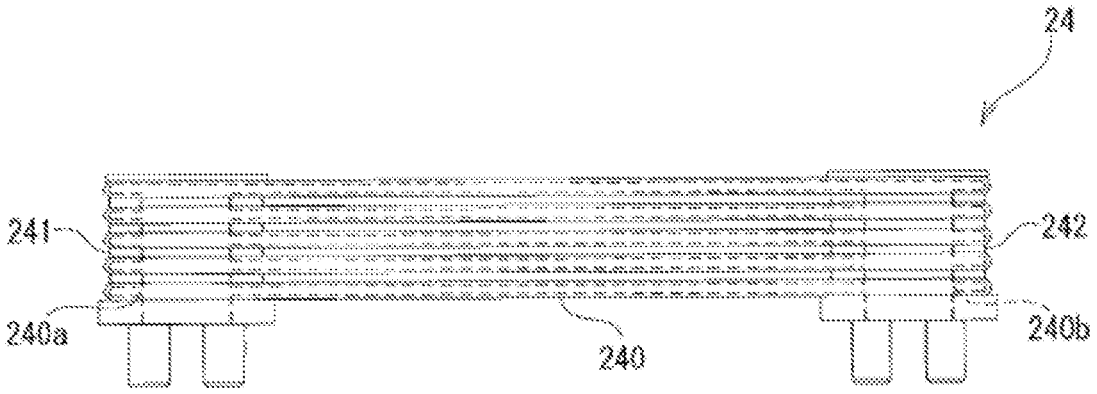
FIG. 4B FRONT VIEW
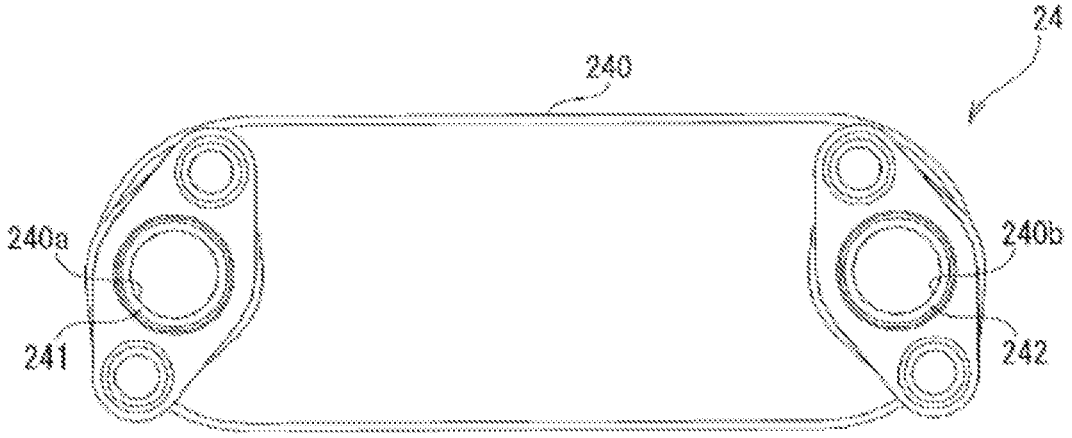

ENGINE

This application is a national phase entry under 35 U.S.C. § 371 of PCT Patent Application No. PCT/JP2018/043388, filed on Nov. 26, 2018, which claims priority under 35 U.S.C. § 119 to Japanese Patent Application No. 2017-240460, filed Dec. 15, 2017, both of which are incorporated by reference.

TECHNICAL FIELD

The present invention relates to an engine having an oil cooler accommodated inside a cylinder block thereof.

BACKGROUND ART

There has been known an engine having an oil cooler for cooling an engine oil accommodated in a cylinder block thereof.

To facilitate heat exchanging of an oil cooler element, the following Patent Literature 1 (hereinafter, PTL 1) describes a structure in which cooling water is supplied from a lower portion to an upper portion of end portions relative to a horizontal direction so that the cooling water spreads the entire oil cooler element. However, in general, support members are provided to support an oil inflow port and an oil ejection port at both end portions of the oil cooler element relative to the horizontal direction. The cooling water therefore may collide with the support members and may not be efficiently supplied to the oil cooler element.

CITATION LIST

Patent Literature

PTL 1: Japanese Examined Utility Model Publication No. H7-655 (1995)

SUMMARY OF INVENTION

Technical Problem

In view of the above described problem, an object of the present invention is to provide an engine that can efficiently supply cooling water to the oil cooler.

Solution to Problem

An aspect of the present invention is an engine including a cylinder block in which a cooling water passage is formed;

an oil cooler accommodated in an accommodation space provided in the cooling water passage and having a plurality of cores for cooling an engine oil;

a pair of support members configured to support an oil inflow port and an oil ejection port of each of the cores;

a cooling water inflow port provided in a lower portion of one end portion of the accommodation space relative to a front-and-rear direction;

a cooling water outflow port provided in an upper portion of the accommodation space; and a cooling water inflow passage having an inclined portion inclined downward and connecting to the cooling water inflow port.

With the above aspect of the present invention, the cooling water passing the inclined portion of the cooling water inflow passage creates a downward flow, resulting in the downward flow of the cooling water to flow from the cooling water inflow port into the accommodation space. Therefore, the cooling water can be efficiently supplied to the entire oil cooler without colliding with the support members.

The above aspect of the present invention may be adapted such that the cooling water inflow passage has an upper protrusion protruding downward from an upper passage wall and a lower protrusion protruding upward from a lower passage wall.

The upper protrusion is arranged closer to the oil cooler than the lower protrusion.

With this structure, the cooling water flowing in the cooling water inflow passage collides with the upper protrusion and flows downward. Therefore, the cooling water does not collide with the support members.

The above aspect of the present invention may be adapted such that a wax pellet that expands or shrinks depending on a temperature of the cooling water is arranged between the oil cooler and a side wall of the accommodation space.

In this structure, the wax pellet shrinks in an occasion such as when the engine is started and the like, in which occasion the temperature of lubrication oil is low. This causes the cooling water to flow into a gap between the wax pellet and the accommodation space, and resulting in a less amount of cooling water flowing between the cores. Therefore, a quick warm up of the engine can be possible. On the other hand, when the temperature of the lubrication oil is high, the wax pellet expands and fills the gap between the wax pellet and the side wall of the accommodation space. This increases the amount of cooling water flowing between the cores, and sufficient heat exchanging of the oil cooler can be achieved.

The above aspect of the present invention may be adapted such that the cooling water inflow passage includes a current plate.

The cooling water ejected from the cooling water pump may form a strong swirl flow. When such a strong swirl flow occurs, the amount of cooling water between the cores decreases, and heat exchanging efficiency of the oil cooler may be deteriorated. With the current plate, however, the swirl flow can be suppressed, and the amount of cooling water flowing between the cores increases. Therefore, the heat exchanging of the oil cooler can be efficient.

The above aspect of the present invention may be adapted such that a protrusion protruding upward is arranged between the pair of support members constituting a bottom surface of the accommodation space.

With the protrusion, the cooling water flowing nearby the bottom surface of the accommodation space collides with the protrusion, increasing the rate of the cooling water flowing to a middle portion of the oil cooler relative to the front-and-rear direction. Therefore, the cooling efficiency can be improved.

BRIEF DESCRIPTION OF DRAWINGS

FIG. 4A A diagram providing a top view.

FIG. 4B A front view of the oil cooler.

EMBODIMENT OF EMBODIMENT

In the following, an embodiment of the present invention will be described with reference to the drawings.

Figure 1:
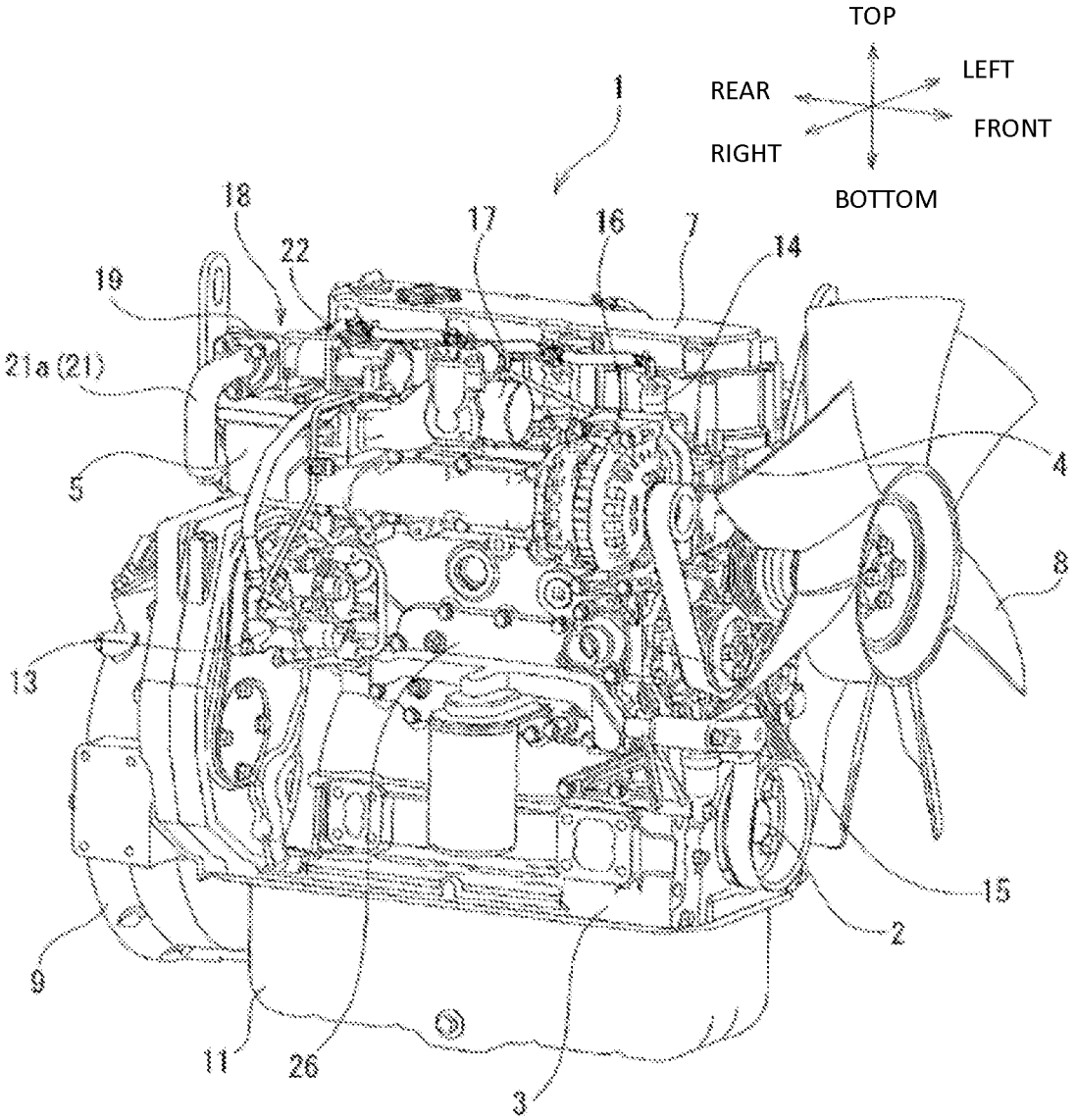
FIG. 1 A perspective view of an engine according to an embodiment.

First, a schematic structure of the engine 1 is described with reference to FIG. 1 and FIG. 2. It should be noted that, in the following description, two sides parallel to a crankshaft 2 are referred to as the left and right. A side where a cooling fan 8 is arranged is referred to as the front side. A side where a flywheel housing 9 is arranged is referred to as the rear side. A side where an exhaust manifold 6 is arranged is referred to as the left side. A side where an intake manifold 5 is arranged is referred to as the right side. A side where a cylinder head cover 7 is arranged is referred to as the upper side. A side where an oil pan 11 is arranged is referred to as the lower side. These expressions are used as the references of four directions and the positional relation of the engine 1.

An engine 1 as a motor mounted to a work machine such as an agricultural machine and a construction machine includes a crankshaft 2 serving as an output shaft of the engine and a cylinder block 3 having therein a piston (not shown). On the cylinder block 3, a cylinder head 4 is mounted. On the right side surface of the cylinder head 4, an intake manifold 5 is arranged. On the left side surface of the cylinder head 4, an exhaust manifold 6 is arranged. The top surface side of the cylinder head 4 is covered by a head cover 7. The crankshaft 2 has its front and rear ends protruding from front and rear surfaces of the cylinder block 3. On the front surface side of the engine 1, a cooling fan 8 is arranged. From the front end side of the crankshaft 2, rotational power is transmitted to the cooling fan 8 through a cooling fan V-belt.

On the rear surface side of the engine 1, a flywheel housing 9 is arranged. The flywheel housing 9 accommodates therein a flywheel 10 pivotally supported at the rear end side of the crankshaft 2. The rotational power of the engine 1 is transmitted from the crankshaft 2 to operating units of the work machine through the flywheel 10. An oil pan 11 for storing an engine oil is arranged on a lower surface of the cylinder block 3. The engine oil in the oil pan 11 is supplied to lubrication parts of the engine 1 through an oil pump in the cylinder block 3, and then returns to the oil pan 11.

A fuel supply pump 13 is arranged below the intake manifold 5 on the right side surface of the cylinder block 3. Further, the engine 1 includes injectors 14 for four cylinders. Each of the injectors 14 has a fuel injection valve of electromagnetic-controlled type. By controlling the opening/closing of the fuel injection valves of the injectors 14, the high-pressure fuel in a common rail is injected from the injectors 14 to the respective cylinders of the engine 1.

On the front surface side of the cylinder block 3, a cooling water pump 15 for supplying cooling water is arranged. The rotational power of the crankshaft 2 drives the cooling water pump 15 along with the cooling fan 8, through the cooling fan V-belt. With the driving of the cooling water pump 15, the cooling water in a radiator (not shown) mounted to the work machine is supplied to the cylinder block 3 and the cylinder head 4 and cools the engine 1. Then the cooling water having contributed to the cooling of the engine 1 returns to the radiator. Above the cooling water pump 15, an alternator 16 is arranged.

The intake manifold 5 is connected to an intake throttle member 17. The fresh air (outside air) suctioned by the air cleaner is subjected to dust removal and purification in the air cleaner, and fed to the intake manifold 5 through the intake throttle member 17, and then supplied to the respective cylinders of the engine 1.

In an upper portion of the intake manifold 5, an EGR device 18 is arranged. The EGR device 18 is a device that supplies part of the exhaust gas of the engine 1 (EGR gas from the exhaust manifold 6) to the intake manifold 5, and includes an EGR pipe 21 connecting to the exhaust manifold 6 through an EGR cooler 20 and an EGR valve case 19 that communicates the intake manifold 5 to the EGR pipe 21.

A downwardly-open end portion of the EGR valve case 19 is bolt-fastened to an inlet of the intake manifold 5 protruding upward from the intake manifold 5. Further, a rightwardly-open end portion of the EGR valve case 19 is coupled to an outlet side of the EGR pipe 21. By adjusting the opening degree of the EGR valve member (not shown) in the EGR valve case 19, the amount of EGR gas supplied from the EGR pipe 21 to the intake manifold 5 is adjusted. The EGR valve member is driven by an actuator 22 attached to the EGR valve case 19.

In the intake manifold 5, the fresh air supplied from the air cleaner to the intake manifold 5 through the intake throttle member 17 is mixed with the EGR gas (part of exhaust gas from the exhaust manifold 6) supplied from the exhaust manifold 6 to the intake manifold 5 through the EGR valve case 19. As described, by recirculating part of the exhaust gas from the exhaust manifold 6 to the engine 1 through the intake manifold 5, the combustion temperature is lowered and the emission of nitrogen oxide (NOX) from the engine 1 is reduced.

The EGR pipe 21 is connected to the EGR cooler 20 and the EGR valve case 19. The EGR pipe 21 includes a first EGR pipe 21*a* arranged on the right side of the cylinder head 4, a second EGR pipe 21*b* formed in a rear end portion of the cylinder head 4, and a third EGR pipe 21*c* arranged on the left side of the cylinder head 4.

The first EGR pipe 21*a* is generally an L-shaped pipe. The first EGR pipe 21*a* has its inlet side coupled to an outlet side of the second EGR pipe 21*b*, and has its outlet side coupled to the EGR valve case 19.

Figure 2:
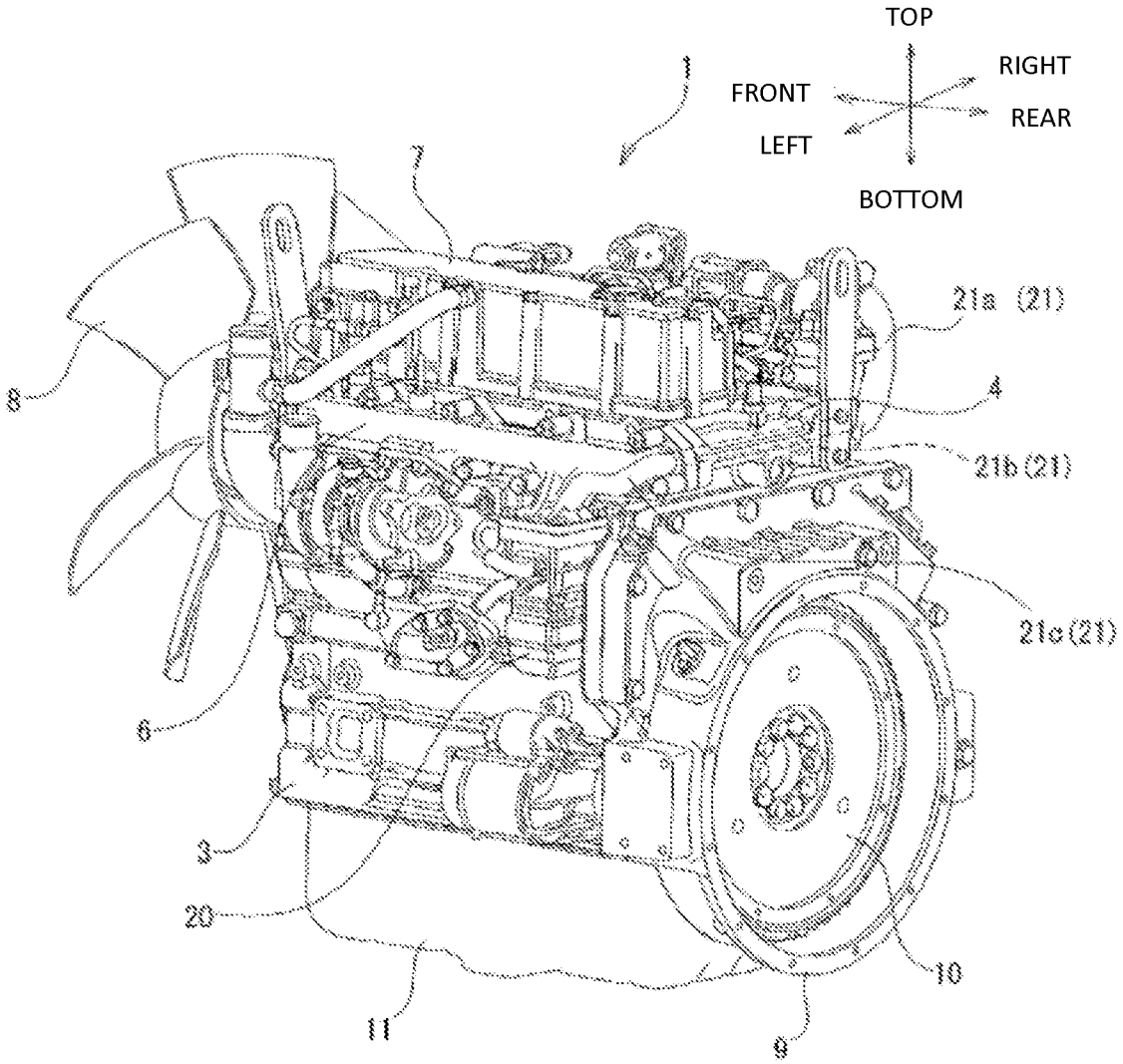
FIG. 2 A perspective view of the engine according to the embodiment.

The second EGR pipe 21*b* is formed in such a manner as to penetrate through the rear end portion of the cylinder head 4 in the left-and-right directions as shown in FIG. 2. In other words, the second EGR pipe 21*b* and the cylinder head 4 are integrally formed. The second EGR pipe 21*b* has its inlet side coupled to an outlet side of the third EGR pipe 21*c*, and has its outlet side connected to the inlet side of the first EGR pipe 21*a*.

The third EGR pipe 21*c* is formed inside the exhaust manifold 6. In other words, the third EGR pipe 21*c* and the exhaust manifold 6 are integrally formed. With the third EGR pipe 21*c* and second EGR pipe 21*b* integrally formed with the exhaust manifold 6 and the cylinder head 4, respectively, the space needed can be saved, and the pipes less likely receive an external impact.

Figure 3:
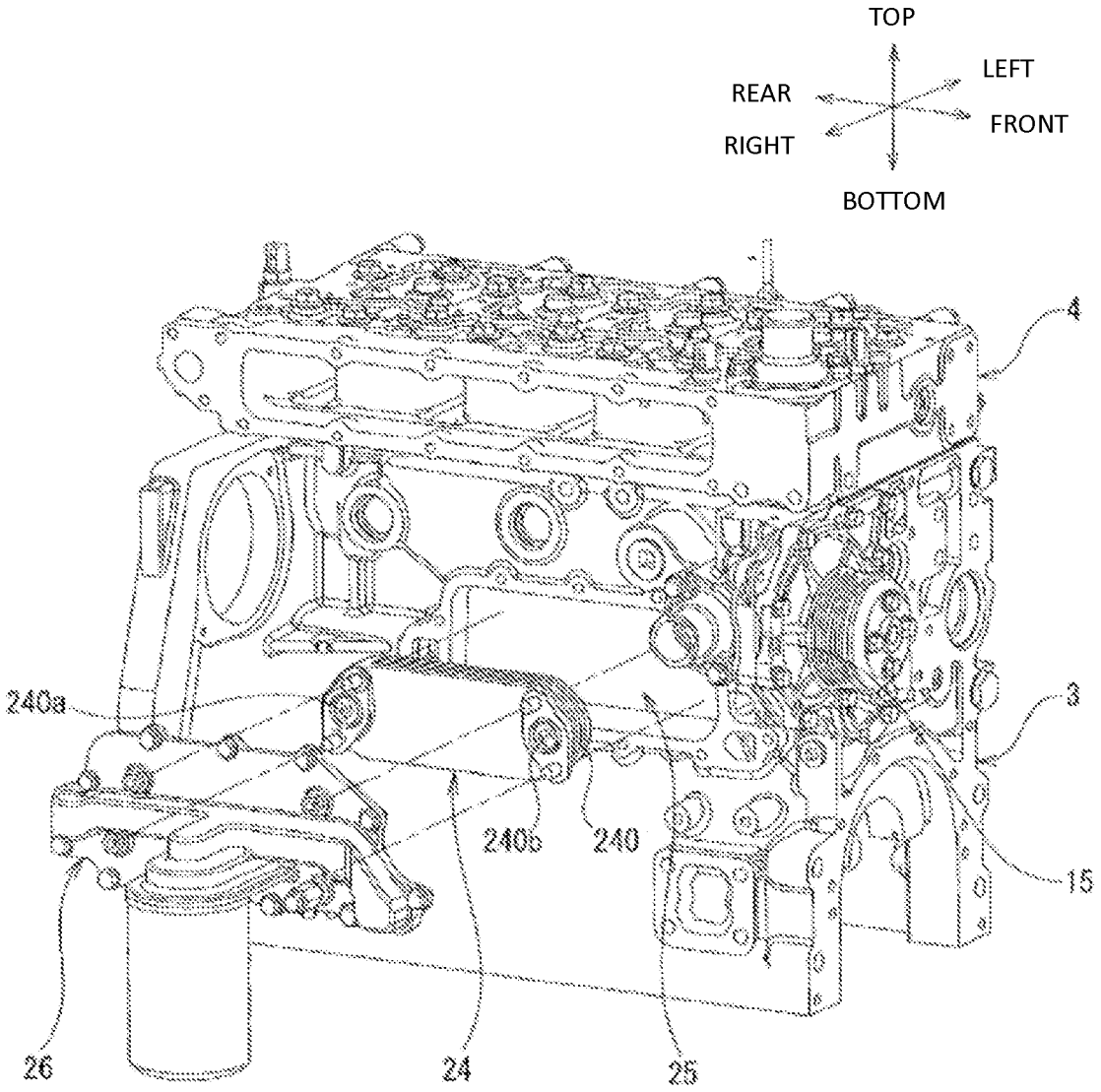
FIG. 3 An exploded perspective view of the vicinity of an oil cooler.
Figure 5:
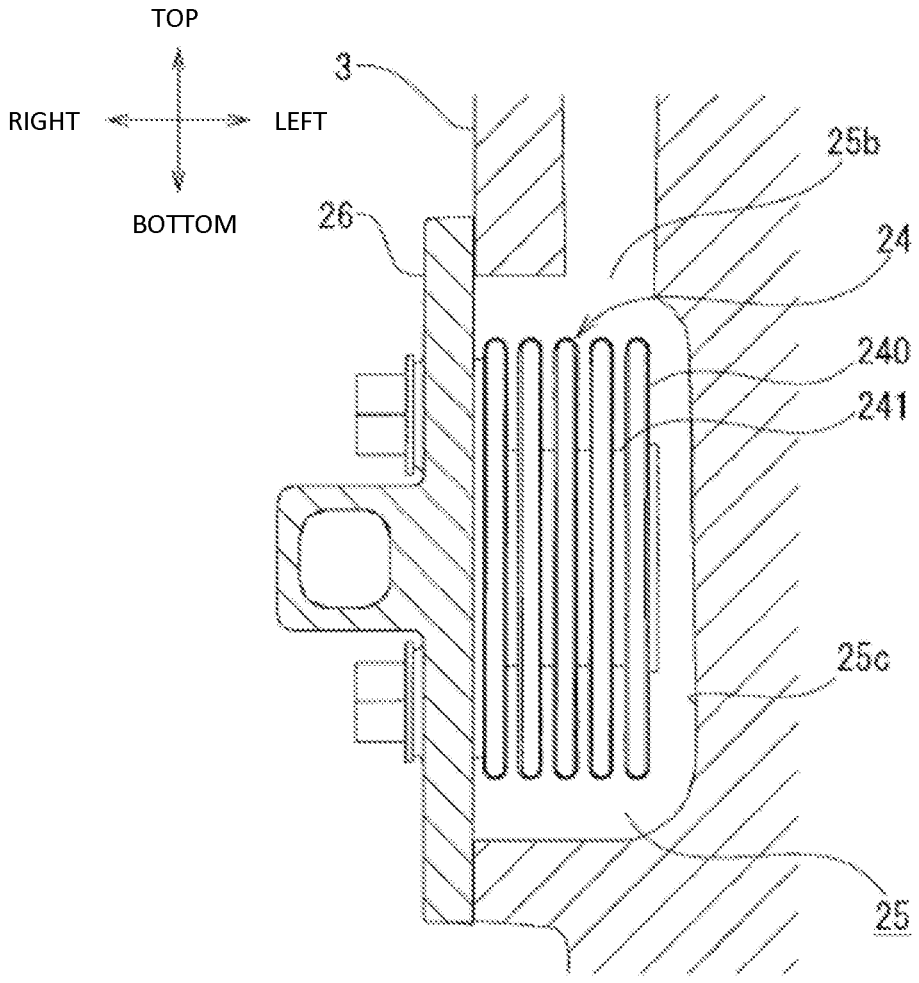
FIG. 5 A cross-sectional view of the vicinity of the oil cooler and an accommodation part.

FIG. 3 is an exploded perspective view of the vicinity of the oil cooler 24. Illustration of some components is omitted in FIG. 3 for the sake of convenience in description. FIG. 4A is a diagram providing a top view and FIG. 4B is a front view of the oil cooler 24. FIG. 5 is a cross-sectional view of the vicinity of the oil cooler 24 and an accommodation part 25.

As is well known, the structure of the oil cooler 24 includes a plurality of plate-like cores 240 (five cores in the present embodiment) which are connected to and spaced from one another, and the engine oil is supplied into each of the cores 240. The engine oil is cooled by heat exchanging with the cooling water around the cores 240.

Each core 240 has an oil inflow port 240*a* and an oil ejection port 240*b*. The oil inflow ports 240*a* of the cores 240 are supported by a first oil pipe 241 (corresponding to support member), and the oil ejection ports 240*b* of the cores 240 are supported by a second oil pipe 242 (corresponding to the support member). The inside of the first oil pipe 241 is in communication with the oil inflow ports 240*a* of the cores 240, and the inside of the second oil pipe 242 is in communication with the oil ejection ports 240*b* of the cores 240. This way, the engine oil passing through the first oil pipe 241 is fed from the oil inflow ports 240*a* to the cores 240, and the engine oil in the cores 240 is ejected to the second oil pipe 242 from the oil ejection ports 240*b*.

In the right side surface of the cylinder block 3, the accommodation part 25 (corresponding to accommodation space) for accommodating therein the oil cooler 24 is formed. The accommodation part 25 is a part of the cooling water passage, and the cooling water in the accommodation part 25 is circulated by the cooling water pump 15. By having the cooling water passing the accommodation part 25, the engine oil in the oil cooler 24 (cores 240) accommodated in the accommodation part 25 is cooled.

A side of the accommodation part 25 is open, and a side plate 26 for closing the opening is fixed to the opening. As shown in FIG. 5, the oil cooler 24 is fixed by a bolt to the side plate 26, with a space between the accommodation part 25 and a side wall 25*c*.

On a surface of the side plate 26 facing the oil cooler 24, a supply port (not shown) and a discharge port (not shown) are provided. The supply port is connected to the first oil pipe 241 to supply engine oil to the oil cooler 24. The discharge port is connected to the second oil pipe 242 to discharge the engine oil ejected from the oil cooler 24.

Figure 6:
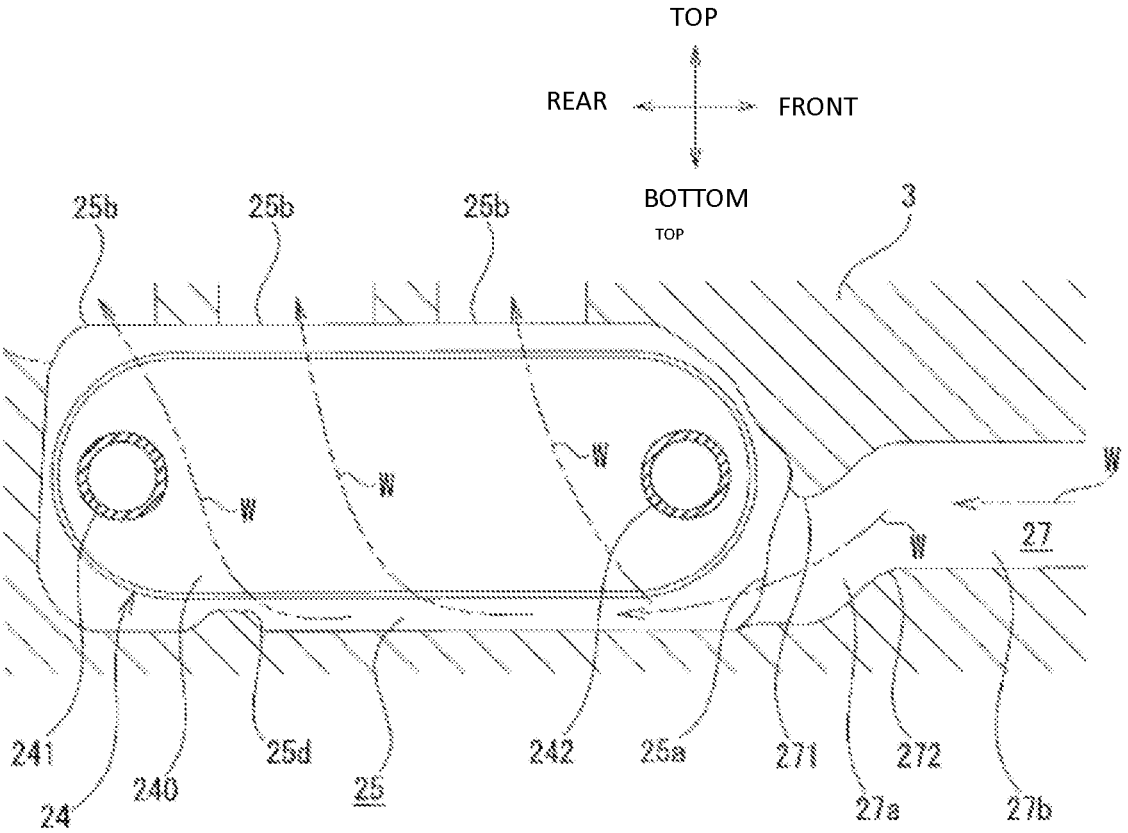
FIG. 6 A cross-sectional view of the vicinity of the accommodation part.

FIG. 6 is a cross-sectional view of the vicinity of the accommodation part 25, and the arrow W indicates the flow of the cooling water. In a lower portion at a front end portion of the accommodation part 25, a cooling water inflow port 25*a* configured to supply the cooling water into the accommodation part 25 is provided. Further, in an upper portion of the accommodation part 25, a cooling water outflow port 25*b* for discharging the cooling water in the accommodation part 25 is provided. In the present embodiment, a plurality of cooling water outflow ports 25*b* are provided. The cooling water supplied through the cooling water inflow port 25*a* flows from the lower portion to the upper portion of the accommodation part 25, flows into the gap between cores 240 and the gap between the oil cooler 24 and the wall surface of the accommodation part 25, and then discharged from the cooling water outflow ports 25*b*. The cooling water discharged from each of the cooling water outflow ports 25*b* then flows into a water jacket of the cylinder block 3 which is in communication with the accommodation part 25.

The cooling water inflow port 25*a* is connected to a cooling water inflow passage 27 which guides the cooling water ejected from the cooling water pump 15. The cooling water inflow passage 27 includes an inclined portion 27*a* closer to the accommodation part 25, and a straight portion 27*b* extended from the inclined portion 27*a* towards the cooling water pump 15. The inclined portion 27*a* is inclined downward and connects to the cooling water inflow port 25*a*. As a result, the cooling water passing through the inclined portion 27*a* forms a downward flow, and the downward flow of the cooling water flows into the accommodation part 25 from the cooling water inlet 25*a*. As a result, the cooling water can be supplied to the entire oil cooler 24 without having the cooling water colliding with the second oil pipe 242.

The cooling water inflow passage 27 includes an upper protrusion 271 protruding downward from an upper passage wall, and a lower protrusion 272 protruding upward from a lower passage wall. The upper protrusion 271 protrudes downward to a level lower than the upper passage wall of the straight portion 27*b*. The lower protrusion 272 protrudes upward to a level higher than a lower end portion of the cooling water inflow port 25*a*. The upper protrusion 271 is arranged closer to the oil cooler 24 (closer to the accommodation part 25) than the lower protrusion 272. With the upper protrusion 271 and the lower protrusion 272 arranged as described above, the inclined portion 27*a* inclined downward is formed. With this structure, the cooling water flowing in the cooling water inflow passage 27 collides with the upper protrusion 271 and flows downward. Therefore, the cooling water does not collide with the second oil pipe 242.

Further, a protrusion 25*d* protruding upward is arranged on the bottom surface of the accommodation part 25. The protrusion 25*d* is arranged in a middle portion of the bottom surface of the accommodation part 25 relative to the front-and-rear direction. More specifically, the protrusion 25*d* is arranged between the first oil pipe 241 and the second oil pipe 242. With the protrusion 25*d*, the cooling water flowing in the vicinity of the bottom surface of the accommodation part 25 collides with the protrusion 25*d*, thus increasing the rate of cooling water flowing in the middle portion of the oil cooler 24 relative to the front-and-rear direction. Therefore, the cooling efficiency can be improved. Further, since the protrusion 25*d* can be formed at the same time when casting the cylinder block 3, no additional cost for machining is necessary. By modifying the shape and the position of the protrusion 25*d* according to the flow of the cooling water, the flow of the cooling water can be optimized without a need for modification of the shape of the oil cooler 24.

Figure 7:
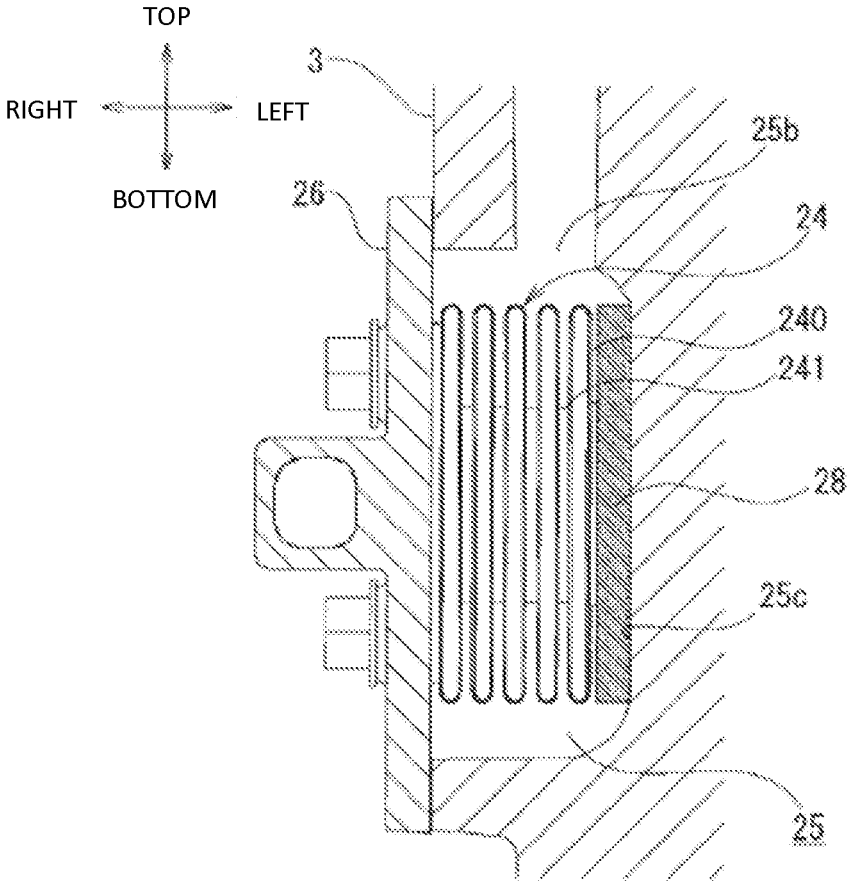
FIG. 7 A cross-sectional view of the vicinity of an oil cooler and an accommodation part related to another embodiment.

Other Embodiments (1) As shown in FIG. 7, a wax pellet 28 that expands and shrinks according to the temperature of the cooling water can be arranged between the oil cooler 24 and the side wall 25*c* of the accommodation part 25. The wax pellet 28 is fixed to a back surface side of the oil cooler 24. The shape of the wax pellet 28 is substantially the same as the shape of the back surface of the oil cooler 24, i.e., the shape of the cores 240. The thickness of the wax pellet 28 is such that the wax pellet 28 contacts the side wall 25*c* of the accommodation part 25 while the wax pellet 28 is expanded, and is separated from the side wall 25*c* while the wax pellet 28 is shrunk.

With the wax pellet 28 between the oil cooler 24 and the side wall 25*c* of the accommodation part 25, the wax pellet 28 is shrunk while the temperature of the lubrication oil is low, such as in an occasion of starting the engine. During this state, the cooling water flows into the gap between the wax pellet 28 and the side wall 25*c* of the accommodation part 25, and the amount of cooling water flowing to the cores 240 is reduced. Therefore, the heat exchange efficiency of the oil cooler 24 is lowered. This enables quick warm up of the engine 1.

On the other hand, when the temperature of the lubrication oil is high, the wax pellet 28 expands and fills the gap between the wax pellet 28 and the side wall 25*c* of the accommodation part 25. This increases the amount of cooling water flowing between the cores 240, and sufficient heat exchanging efficiency of the oil cooler 24 can be achieved.

Figure 8:
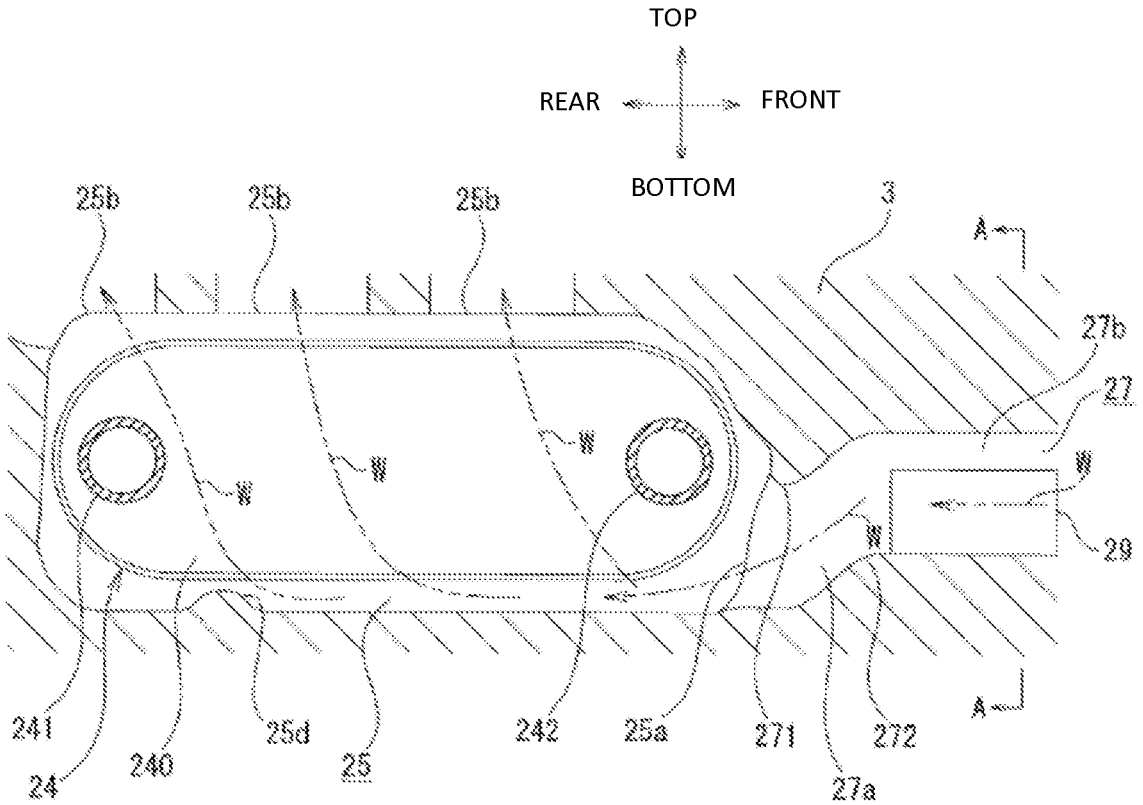
FIG. 8 A cross-sectional view of the vicinity of the accommodation part related to the other embodiment.
Figure 9:
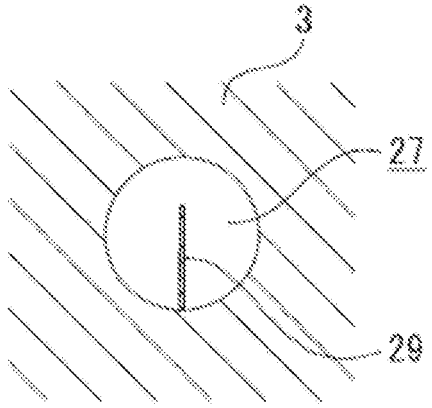
FIG. 9 A cross-sectional view taken along the line A-A of FIG. 8.

(2) As shown in FIG. 8 and FIG. 9, a current plate 29 may be provided to the cooling water inflow passage 27. The current plate 29 is provided along the straight portion 27*b* of the cooling water inflow passage 27. As shown in FIG. 9, the current plate 29 is arranged in a standing posture in a middle of the cooling water inflow passage 27, parallel to the cores 240 of the oil cooler 24. Note that at least one current plate 29 is sufficient. However, two or more current plates 29 may be provided. In cases of providing two or more current plates 29, the current plates 29 are arranged in a standing posture and arranged side-by-side in a left-and-right direction.

The cooling water pump 15 is structured by a centrifugal pump, and the cooling water ejected from the cooling water pump 15 may form a strong swirl flow inside the cooling water inflow passage 27. When such a strong swirl flow occurs, the cooling water easily flows around the oil cooler 24 due to the centrifugal force, which results in a decrease in the amount of cooling water to the cores 240 and a drop in the heat exchanging efficiency of the oil cooler 24. With the current plate 29, however, the swirl flow can be suppressed, and the amount of cooling water flowing between the cores 240 increases. Therefore, the heat exchanging efficiency of the oil cooler 24 is improved.

An embodiment of the present invention has been described with reference to the drawings. It however should be considered that specific configurations of the present invention are not limited to this embodiment. The scope of this invention is indicated by the range of patent claims as well as the description of the enforcement form described above, as well as the range of patent claims and even meaning and all changes within the range.

REFERENCE SIGNS LIST 1 engine
3 cylinder block
12 oil filter
15 cooling water pump
24 oil cooler
25 accommodation part
25*a* cooling water inflow port
25*b* cooling water outflow port
25*c* side wall
27 cooling water inflow passage
27*a* inclined portion
27*b* straight portion
28 wax pellet
29 current plate
240 core
240*a* oil inflow port
240*b* oil ejection port
241 first oil pipe
242 second oil pipe
271 upper protrusion
272 lower protrusion

The invention claimed is:

1. An engine, comprising:
a cylinder block in which a cooling water passage is formed;
an oil cooler accommodated in an accommodation space provided in the cooling water passage and having a plurality of cores for cooling an engine oil;
a pair of support members configured to support an oil inflow port and an oil ejection port of each of the cores;
a cooling water inflow port provided in a lower portion of one end portion of the accommodation space and guiding water to the accommodation space;
a cooling water outflow port provided in an upper portion of the accommodation space; and
a cooling water inflow passage having an inclined portion inclined downwardly guiding water towards under the oil cooler and connecting to the cooling water inflow port.

2. The engine according to claim 1, wherein the cooling water inflow passage has an upper protrusion protruding downward from an upper passage wall and a lower protrusion protruding upward from a lower passage wall, and
the upper protrusion is arranged closer to the oil cooler than the lower protrusion.

3. The engine according to claim 1, wherein a wax pellet that expands or shrinks depending on a temperature of the cooling water is arranged between the oil cooler and a side wall of the accommodation space.

4. The engine according to claim 1, wherein the cooling water inflow passage includes a current plate.

5. The engine according to claim 1, comprising a protrusion protruding upward, the protrusion being arranged between the pair of support members constituting a bottom surface of the accommodation space.

6. The engine according to claim 4, wherein the current plate is provided along a straight portion which is located upstream from the inclined portion.

7. The engine according to claim 5, wherein the protrusion protrudes upward towards the oil cooler but space away from the oil cooler.

* * * * *